US007484573B2

(12) United States Patent
Mackay et al.

(10) Patent No.: US 7,484,573 B2
(45) Date of Patent: Feb. 3, 2009

(54) SLIP GRIP DRILLING TOOL

(75) Inventors: Craig Mackay, Aberdeen (GB); Simon Fraser, Banchory (GB); James Adam Hewson, Aberdeen (GB)

(73) Assignee: Technology Ventures Ltd. (GB)

( * ) Notice: Subject to any disclaimer, the term of this patent is extended or adjusted under 35 U.S.C. 154(b) by 109 days.

(21) Appl. No.: 11/314,995

(22) Filed: Dec. 21, 2005

(65) Prior Publication Data

US 2006/0219440 A1 Oct. 5, 2006

(30) Foreign Application Priority Data

Apr. 5, 2005 (GB) ..... 0506864.8

(51) Int. Cl.
*E21B 7/04* (2006.01)

(52) U.S. Cl. ..... 175/61; 175/81; 175/74; 175/325.3

(58) Field of Classification Search ..... 175/61, 175/81, 325.3, 74
See application file for complete search history.

(56) References Cited

U.S. PATENT DOCUMENTS

| | | | | |
|---|---|---|---|---|
| 2,495,439 A * | 1/1950 | Brimble | ..... | 175/81 |
| 4,948,925 A * | 8/1990 | Winters et al. | ..... | 175/48 |
| 7,234,544 B2 * | 6/2007 | Kent | ..... | 175/74 |

* cited by examiner

*Primary Examiner*—Jennifer H Gay
*Assistant Examiner*—Brad Harcourt
(74) *Attorney, Agent, or Firm*—Christopher L. Makay

(57) ABSTRACT

A directional drilling apparatus for mounting a drill bit on a rotatable drill support comprises a member for transmitting rotation from the drill support to a drill bit, and a body mounted to the member. The body is configurable to offset a portion of the member relative to an axis of the body such that directional drilling may be achieved.

37 Claims, 5 Drawing Sheets

SLIP GRIP DRILLING TOOL

CLAIM FOR RIGHT OF PRIORITY UNDER 35 U.S.C. §119(b)

This present application claims all available benefit, under 35 U.S.C. §119(b), of Utility Patent Application No. GB0506864.8, filed in the United Kingdom on Apr. 5, 2005.

FIELD OF THE INVENTION

This invention relates to directional drilling. In particular this invention relates to directional drilling apparatus and to a directional drilling method.

BACKGROUND OF THE INVENTION

When drilling deep bores, such as in the oil and gas exploration and production industry, it is now conventional to select and control the inclination and azimuth of a bore as it is drilled. One technique employed to achieve this is known as directional drilling; this typically involves the use of a "bent" sub towards the end of a drilling string. The axis of the bent sub includes a small deviation, perhaps of 0.5 degrees, and thus has the effect of directing the drill bit away from bore axis. When the drill string is rotated from surface, the bent sub is rotated and the effect of the deviation is negated. However, if a downhole motor is utilised to rotate the drill bit, and the bent sub is held at a desired orientation, the drill bit will deviate from the bore axis.

It is widely recognised that better drilling rates are achieved when a drill string is rotated from surface, and that there are many disadvantages associated with drilling operations in which the drill bit is rotated by a downhole motor mounted on a non-rotating string. Accordingly, there have been numerous proposals for "rotary steerable" systems, that is drilling arrangements which allow the drilling direction to be controlled while still permitting the drill string and bit to be rotated from surface. The applicant has made a number of proposals in respect of such systems, as described in UK Patent GB2382361B, International Patent Application WO 03/102353, U.S. patent application Ser. No. 10/785,456, and UK Patent Application GB2394235A, the disclosures of which are incorporated herein by reference.

It is among the objectives of embodiments of the present invention to provide directional drilling apparatus and methods which achieve this aim.

SUMMARY OF THE INVENTION

According to an aspect of the present invention there is provided a directional drilling apparatus for mounting a drill bit on a rotatable drill support, the apparatus comprising:

a member for transmitting rotation from a rotatable drill support to a drill bit; and a body mounted to the member and comprising a plurality of relatively movable parts, at least part of the body being configurable to resist rotation in a bore, and the body further being configurable such that application of force to at least a part of the body causes parts of the body to move relative to one another and offset a portion of said member relative to an axis of the body.

According to another aspect of the invention there is provided a directional drilling method comprising the steps:

providing a drill bit on a bit-mounting member in a body;

mounting the member on a drill support and locating the bit, member and body in a bore;

applying a force to the body to move parts of the body relative to one another and offset a portion of the bit-mounting member from an axis of the body; and rotating the drill support to rotate the drill bit, such that a deviated bore is drilled.

These aspects of the present invention allow for directional drilling, wherein the drilling of a deviated bore may be achieved by changing the configuration of the body by application of force, which may be achieved relatively easily in a drilling operation. The force may be an axially applied force. The force may be applied mechanically, for example by application of weight to a drill support, and/or may be a pressure force, for example a differential and/or flow-induced fluid pressure induced force.

Preferably, parts of the body are relatively rotatable, and rotating one part relative to another creates the offset. In a preferred embodiment, each of the parts includes an offset, and in one relative orientation the offsets are compounded, and in another relative rotation the offsets are cancelled out. The body parts may be sleeves, and an inner part may provide mounting for the bit-mounting member.

Preferably, parts of the body are configured such that relative axial movement of said parts induces relative rotation of said parts. Said parts may define cooperating screw threads, and in one embodiment one part defines a track, which may be helical, and another part defines a track follower, which may take the form of a ball bearing.

Preferably, part of the body is extendable to engage a bore wall, and thus restrict rotation of the body part. The extendable part of the body may take any appropriate form, and may be mechanically actuated. For example, the part may be extended by cooperation with another part of the body. In a preferred embodiment, the extendable part of the body comprises a blade mounted for radial movement relative to a body sleeve. Preferably, the extendable body part is movable by engagement with a cam surface, which surface may be defined by a relatively axially movable body part, movement of which may also create the offset. In another embodiment, the extendable part is hydraulically actuated.

In the preferred embodiment, axial force is applied to the apparatus to create the offset. Preferably, a member is adapted to permit application of an axial force to the body by the member. The member may comprise a plurality of relatively movable parts, and at least one of said parts may be coupled to a part of the body to permit application of an axial force thereto, to create the offset. Preferably, the axial force is applied by applying weight to the drill support. Preferably, parts of the member are relatively axially movable, and may be telescopic.

The coupling between the parts of the member and body may be such to permit relative rotation, for example via a bearing.

The coupled parts of the member and body may be selectively locked to prevent relative axial movement there between. The coupled parts may be locked in position to provide said offset, or may be locked in position to provide no offset. In one embodiment, the parts are locked by locking members extending between parts of the member and the body, and a fluid-actuated member may selectively support the locking members in a locking position. The fluid-actuated member may be normally biased to a non-supporting position, such that reducing the flow rate of fluid through the apparatus allows the parts to be moved.

Preferably, the coupled parts of the member and the body are normally biased to a position to provide no offset.

Preferably, means is provided for determining the orientation of the offset. In one embodiment the high side of a bore is determined and the relative orientation of the offset relative to the high side is determined.

In the preferred embodiment, a mechanism is provided to return the parts to a respective datum position to aid in determining the orientation of the offset.

BRIEF DESCRIPTION OF THE DRAWINGS

These and other aspects will now be described, by way of example, with reference to the accompanying drawings, in which.

DETAILED DESCRIPTION OF THE DRAWINGS

Figure 1:
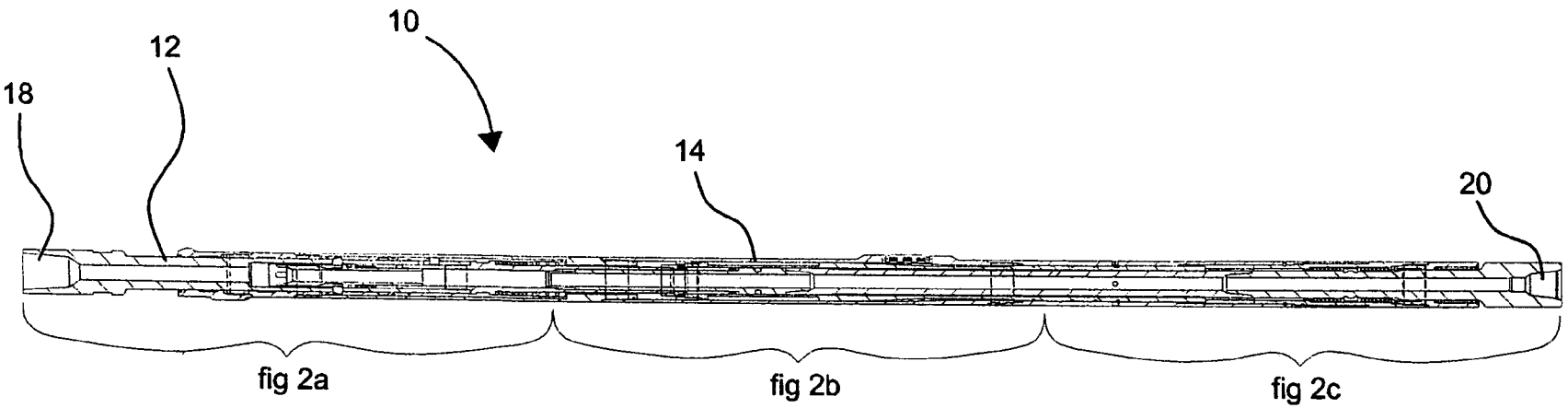
FIG. 1 is a sectional view of directional drilling apparatus in accordance with an embodiment of the present invention.

The drawings show a directional drilling apparatus 10 for mounting a drill bit (not shown) on a drill string (not shown). As will be described, the apparatus 10 has utility in drilling deviated bores, where the rotation of the drill bit is achieved by rotating the drill string from surface.

The apparatus 10 comprises a central hollow member 12 for transmitting rotation and weight from the drill string through the apparatus 10 to the drill bit. The member 12 extends through a body 14 which may be configured to offset the lower end of the member 12 from the main member/body axis 16. The main elements of the apparatus 10 will first be describe in brief, followed by a more detailed description.

An upper end of the member 12 defines a conventional box coupling 18, to engage the lower end of the string, while the lower end of the member defines a coupling 20 for engaging the bit. As will be described, the member 12 comprises a number of parts, including a telescopic portion, which permits application of an axial force to parts of the body 14, to provide the offset.

Figure 2A:
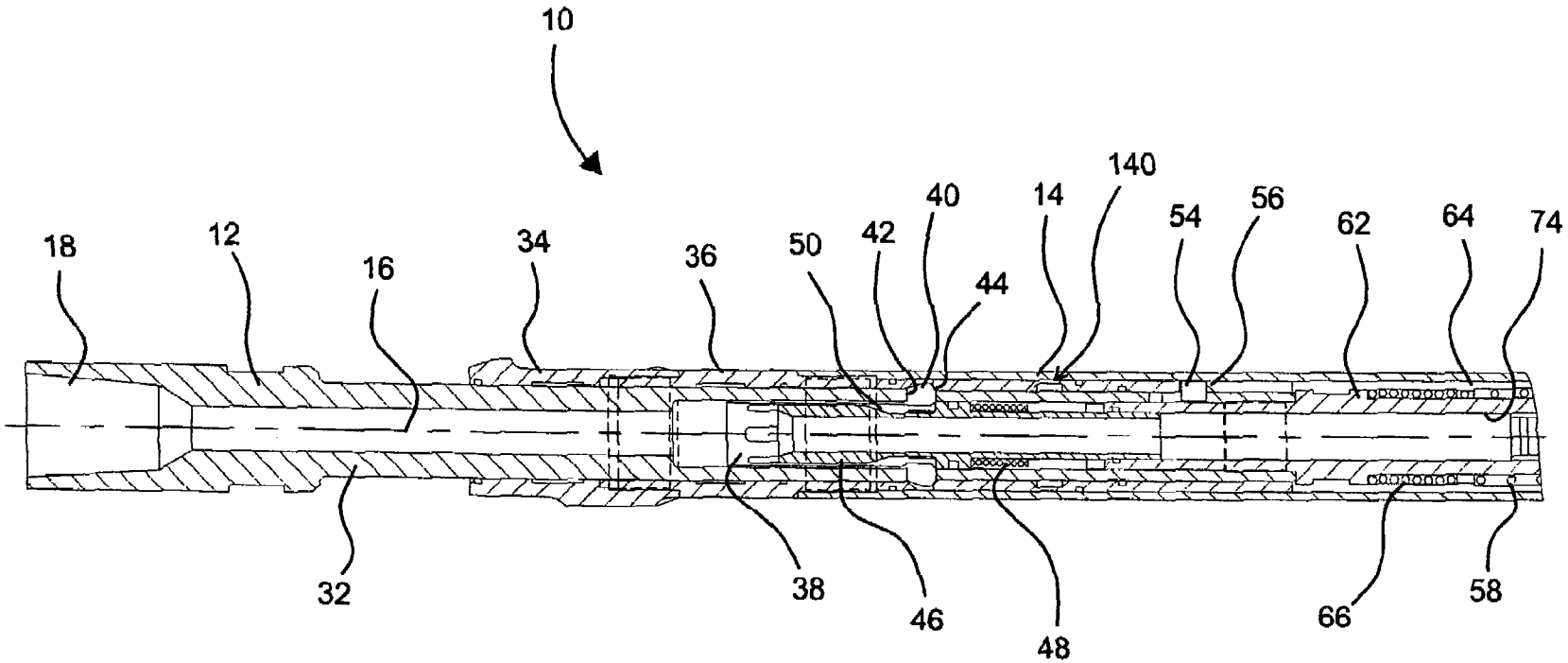
FIG. 2 is an enlarged view of the apparatus of FIG. 1 (on three sheets)
Figure 2B:
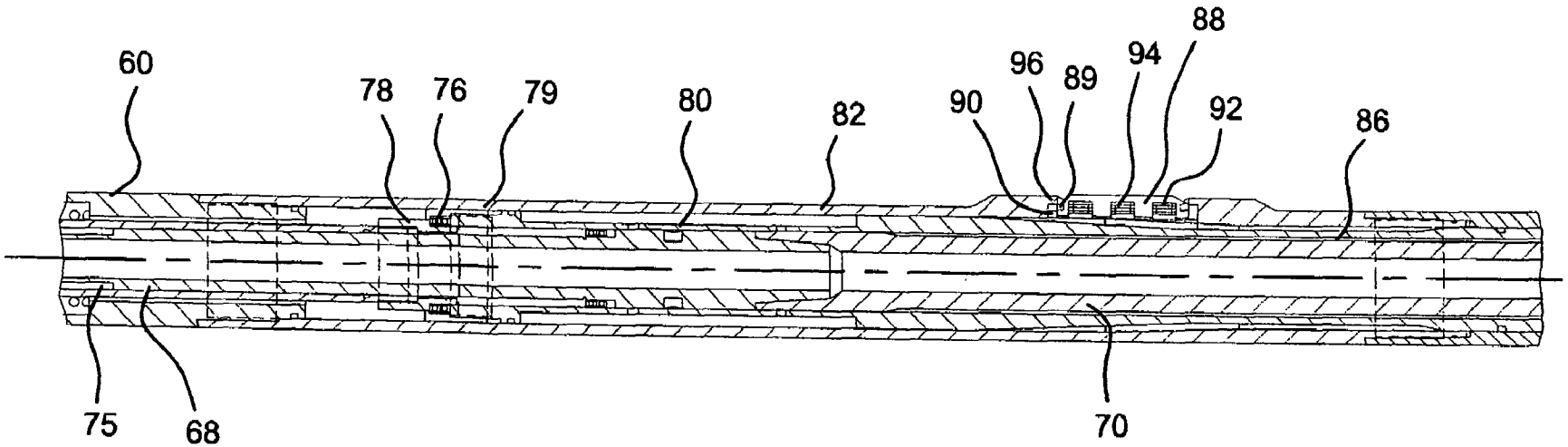
Figure 2C:
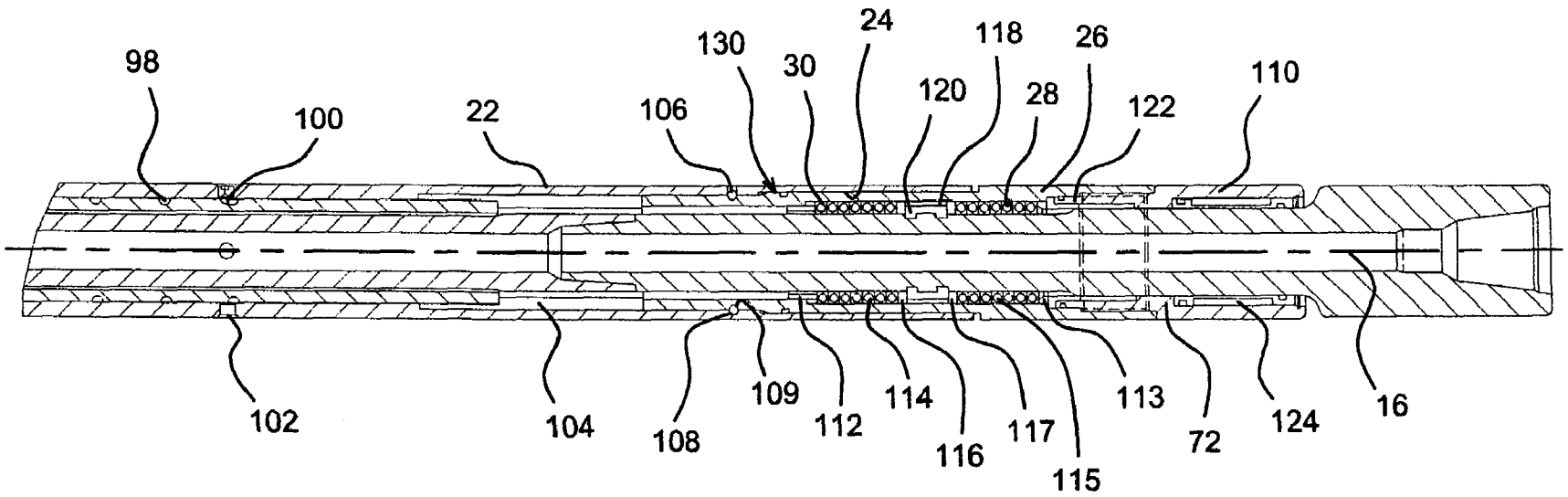

The body 14 comprises a lower outer housing 22, the lowermost end of which defines an offset bore 24 accommodating an orientation housing 26 (FIG. 2*c*). The housing 26 itself defines a bore 28 for accommodating the lower end of the member 12, the bore 28 being offset from the profiled outer surface 130 of the housing 26. A bearing arrangement 30 within the housing 26 supports the lower end of the member 12. In one relative orientation of the housings 22, 26, the offsets cancel out such that the axes of the member 12 and the body 14 coincide. However, if the sleeves 22, 26 are then rotated through 180 degrees relative to one another, the offsets become cumulative such that the axis of the end portion of the member 12 is then offset from the axis of the body.

The apparatus 10, and its operation, will now be described in greater detail.

The upper end of the member 12 (FIG. 2*a*) is formed by an upper mandrel top sub 32 and extends into the upper end of the body 14, formed by a housing 34 and an orientating sleeve 36. In the illustrated embodiment the housing 34 accommodates an MWD sensor. In normal operation, the member 12 is locked axially relative to the body 14 by a locking collet 38 mounted within the top sub 32. The ends of the collet fingers 40 are biased to extend through windows 42 in the top sub 32 into pockets 44 in the orientating sleeve 36. The fingers 40 are normally supported in a radially extended position by a locking piston 46 within the top sub 32. The piston 46 forms a differential piston such that drilling fluid flowing through the apparatus, and through the piston 46, tends to push the piston 46 downwardly, against the action of a return spring 48, such that an upper portion 50 of the piston 46 supports the collet fingers 40. However, when the flow of drilling fluid through the apparatus 10 stops or is reduced, the spring 48 will raise the piston 46, removing support from the fingers 40. The figures illustrate the fingers 40 extended, but unsupported.

The transfer of rotational movement from the top sub 32 to the orientating sleeve 36 is controlled by the collet fingers 40 and a tool orientation slug 54 mounted on the lower end of the sub 32, and which slug 54 engages a flared-end slot 56 defined by the lower end of the orientating sleeve 36.

The top sub 32 is biased upwardly relative to the sleeve 36 by a mandrel spring 58 which acts between a shoulder formed on an upper housing 60 (FIG. 2*b*) coupled to the orientating sleeve 36 and an upper mandrel lower sub 62 which is fixed to the lower end of the top sub 32. The mandrel spring 58 acts on the lower sub 62 via a thrust transmission sleeve 64 and a bearing arrangement including angular contact ball-bearings 66.

The lower end of the member 12 is axially fixed relative to the body 14, such that the member 12 must be configured to permit relative axial movement between the upper part of the member 12, in the form of the subs 32, 62, and the lower part of the member 12, in the form of a drive shaft 68, a flexible shaft 70, and an output shaft 72 (FIG. 2*c*). Thus, in this embodiment, the lower end of the lower sub 62 and the upper end of the drive shaft 68 engage via corresponding hexagonal profiles 74, 75.

The axial movement of the lower sub 62 is transmitted, via radial ball-bearings 76 between bearing retainers 78, 79, to a sliding mandrel 80 which extends through an annular space between the shafts 68, 70, 72 and a stabiliser body 82 and the lower outer housing 22.

An intermediate portion of the sliding mandrel 80 defines a cam surface 86 which co-operates with three extendible members in the form of solid knives 88 (only one shown) located in windows 89 in the stabiliser body 82. Each knife 88 engages the mandrel surface 86 via a carrier 90, the knife 88 being resiliently mounted on the carrier 90 via spring dowels 92 and disc springs 94. Furthermore, the knife 88 is biased radially inwardly by leaf-springs 96 provided between the knife 88 and the stabiliser body 82.

Thus, as the sliding mandrel 80 is moved axially downwards relative to the stabiliser body 82, the knives 88 are urged radially outwardly, into contact with the surrounding bore wall, preventing rotation of the body 14 relative to the bore, and permitting the member 12 to rotate independently of the body 14.

The lower part of the sliding mandrel 80 (FIG. 2*c*) defines a helical groove 98. Ball-bearings 100, located by retainers 102 in the lower outer housing 22, co-operate with the groove 98, with the result that axial movement of the mandrel 80 relative to the lower outer housing 22 induces rotation of the mandrel 80 relative to the housing 22. This rotation is transferred, via tines 104, to the orientation housing 26. As noted above, the orientation housing 26 is rotatable relative to the lower outer housing 22, but relative axial movement of the housings 22, 26 is prevented by retained ball-bearings 106 located in opposing annular grooves 108, 109 provided in the housings 22, 26.

As noted above, the lower end of the member 12 is supported within the lower end of the body 14 by a bearing arrangement 30, and in particular the bearing arrangement 30 is provided between the orientation housing 26 and the output shaft 72, the bearing arrangement 30 being retained in place by a collar 110 which engages the lower end of the housing 26. The bearing arrangement 30 comprises upper and lower thrust washers 112, 113, upper and lower sets of angular contact ball-bearings 114, 115, bearing thrust washers 116, 117, and a locking collar 118 which engages with a profile 120 formed in the outer surface of the output shaft 72. Furthermore, a lower rotary bearing 122 is provided between the output shaft 72 and the retaining collar 110. Also provided between the shaft 72 and the collar 110 is a pressure compensation piston 124.

In use, a drill bit is coupled to the lower end of the apparatus 10 via the coupling 20, and the apparatus 10 is then mounted on the lower end of a drill string via the box coupling 18. The apparatus 10 is then run into the bore to the required depth. To drill "straight ahead", drilling fluid is circulated through the apparatus 10, and in particular the drilling fluid will pass through the drill string, through the centre of the member 12, and then exit the drill bit via jetting nozzles. The flow of drilling fluid through the apparatus 10 urges the locking piston 46 downwardly to support the collet fingers 40 in the position as shown in the figures such that the body 14 is both axially and rotationally coupled to the member 12. As the relative orientation of the lower outer housing 22 and the orientation housing 26 is initially arranged such that the offsets cancel themselves out, the axis of the output shaft 22 will coincide with the main body axis 16.

If however it is desired to introduce a deviation into the bore, the rotation of the drill string is stopped, and the drilling fluid pumps shut down. The cessation of flow of drilling fluid through the apparatus allows the return spring 48 to push the locking piston 46 upwards to de-support the collet fingers 40. If weight is then applied to the string at surface, the collet fingers 40 will be deflected inwardly and the upper end of the member 12, in particular the upper mandrel top and lower subs 32, 62, will be free to move axially downwards relative to the upper end of the body 14, in particular the orientating sleeve 36. The axial movement of the subs 32, 62 is communicated to the sliding mandrel 80, the movement of the mandrel 80 relative to the stabiliser body 82 causing the knives 88 to be moved radially outwards into engagement with the surrounding bore wall. As described below, this engagement with the bore wall prevents rotation of the body 14 and thus maintains the direction of offset created by the manipulation of the parts of the body 14, and so allows the offset angle introduced into the output shaft 72 and drill bit to cause a directional bore to be drilled.

Furthermore, as the mandrel 80 moves downwards, the interaction of the helical groove 98 and the ball-bearings 100 causes the mandrel 80 to rotate relative to the stationary stabiliser body 82. This rotation of the mandrel 80 is transferred to the orientation housing 26.

The apparatus 10 is configured such that one full stroke of the subs 32, 62 relative to the body 14 is translated to a 180 degrees rotation of the housing 26, which maximises the effect of the offsets in the housings 22, 26 and offsets the axis of the output shaft 72 and the drill bit relative to the main axis of the body 14.

The offsetting of the axis of the output shaft 72 is accommodated by the provision of the flexible shaft 70, which will flex to accommodate the deflection of the output shaft.

If the drilling fluid pumps are then restarted the locking piston 46 is again urged downwardly to support the collet fingers 40 in the lower annular groove 140, which axially restrains the upper part of the member 12 relative to the upper part of the body 14, while permitting the member 12 to rotate relative to the body 14. This locks the tool in oriented mode. When rotation of the drill string commences once more, the member 12 will now be free to rotate relative to the stationary body 14, by virtue of the disengagement of the tool orientation pin 54 from the profile 56 and the disengagement of the collet fingers 40 from the pockets 44. The axial compression of the member 12 is accommodated by the hex-profiles 74, 75 and the tines 104.

As the output shaft 72 and the drill bit mounted thereon are now located on an axis inclined to the main body axis 16, the bit will now drill at an angle to the axis 16.

When the operator wishes to return to "straight ahead" drilling, rotation of the drill string is stopped and the drilling fluid pumps are shut down. The locking piston 46 will be urged upwardly by the piston return string 48, and if weight is relieved from the string, the subs 32, 62 will move upwards relative to the body 14, under the influence of the mandrel spring 58. The corresponding upward movement of the sliding mandrel 80 relative to the lower outer housing 22 will result in rotation of the mandrel 80 and the orientation housing 26, such that the offsets on the housings 22 and 26 are then oriented such that the offsets are cancelled out, and the output shaft 72 axis and therefore the drill bit axis are once more positioned on the main body axis 16.

Figure 3:
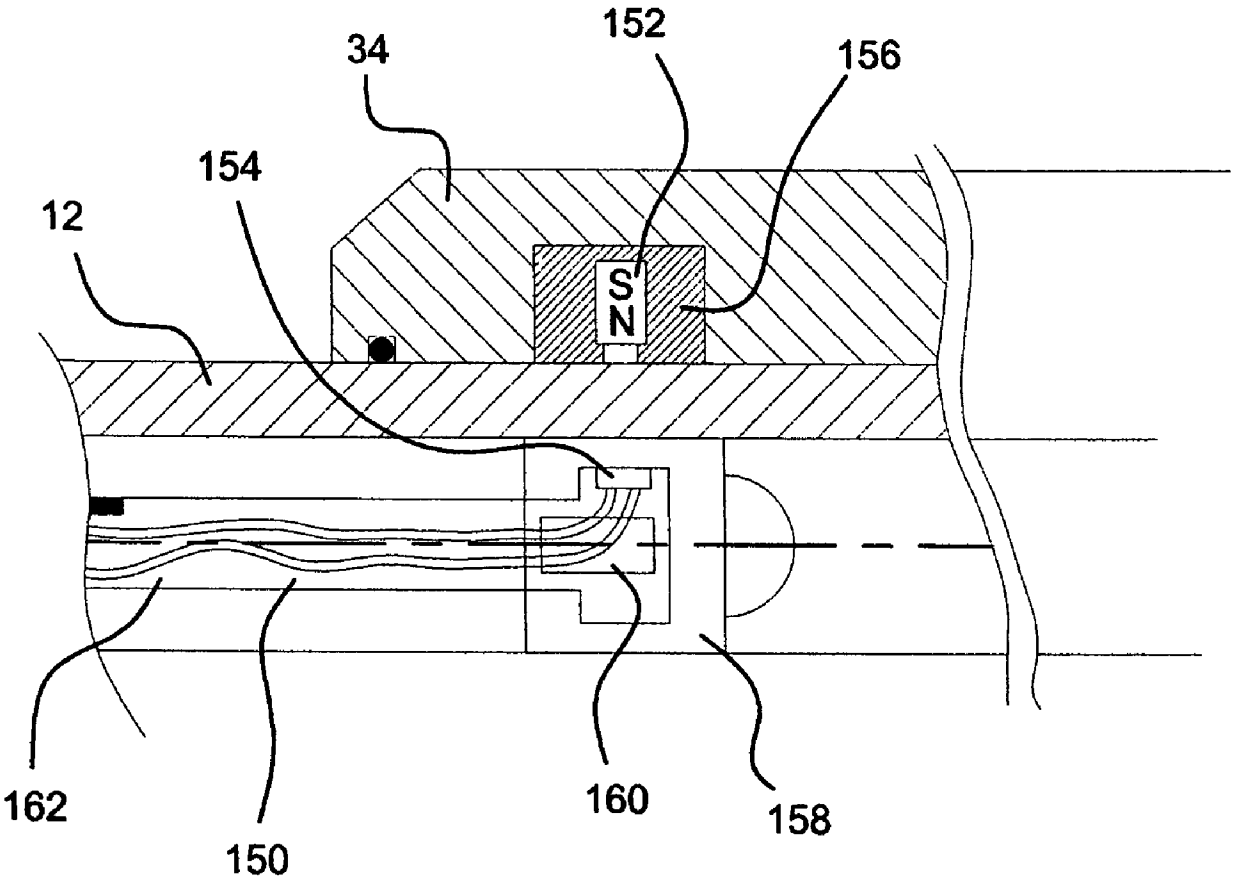
FIG. 3 is an enlarged sectional view of part of the apparatus and part of an MWD probe which has been located within the apparatus.

During a drilling operation, the orientation of the body 14 in the bore, and thus the orientation of the offset, is monitored by an appropriate MWD apparatus, as illustrated in FIG. 3, which may take the form of a probe 150 run into the apparatus 10 as and when required. The MWD probe 150 includes a sensor, typically an accelerometer, which allows the high side of the bore to be identified. The orientation of the body 14 relative to the high side is detected by provision of, for example, a magnet 152 on the housing 34 and a magnetic sensor 154 in the lower end of the probe 150, the probe 150 being located such that the sensor 154 is adjacent the magnet 152. The magnet 152 is potted within a dielectric 156, while the sensor 154 is mounted in a centralised non-magnetic sensor assembly 158. The sensor assembly 158 accommodates an electronics assembly 160, from which wiring extends upwards, through a pressure housing 162, to the main MWD system. The sensor 154 rotates with the member 12, within the body 14, and as the sensor 154 passes the magnet 152 the sensor 154 produces an output. By comparing the time of arrival of this output with the time when high-side is detected, it is possible to compute the position of the stationary body 14 relative to the rotating member 12, and thus determine the orientation of the offset in the bore. The main MWD system transmits this data to surface.

It will be apparent to those of skill in the art that the above described apparatus provides a rotary steerable tool of relatively simple operation and construction.

It will also be apparent to those of skill in the art that the above described embodiment is merely exemplary of the present invention, and that various modifications and improvements may be made thereto without departing from the scope of the present invention. For example, it is possible to utilise a pressure release mechanism, rather than an MWD tool as described above, to sense rotation or slippage of the body 14. In one example, the stabilisers are activated in a specific axial orientation with respect to the inner and outer sleeves. A pressure port can be machined between the inner and outer sleeve such that when the stabilisers, inner sleeve and outer sleeve are correctly oriented, which would be the case when there is no slippage of the stabilisers, this port is closed. The port would open when for instance the outer sleeve and inner sleeve had rotated, say 30 degrees relative to each other. The resultant pressure drop observed at surface would demonstrate that slippage had occurred and the tool would need resetting into the correct orientation.

The invention claimed is:

1. A directional drilling apparatus for mounting a drill bit on a rotatable drill support, the apparatus comprising:

a member for transmitting rotation from a rotatable drill support to a drill bit, wherein the member comprises a plurality of relatively movable member parts; and a body mounted to the member and comprising a plurality of relatively movable body parts, at least part of the body being configurable to resist rotation in a bore, wherein at least one of said parts of the member is coupled to a part of the body such that the coupled parts of the member and the body are normally biased to a position to provide no offset, further wherein the body is configurable such that application of a longitudinally axial force to at least a part of the body causes parts of the body to move relative to one another and offset a portion of said member relative to an axis of the body.

2. The directional drilling apparatus of claim 1, wherein the force is applied mechanically.

3. The directional drilling apparatus of claim 2, wherein the force is applied by application of weight to a drill support.

4. The directional drilling apparatus of claim 1, wherein parts of the body are relatively rotatable, and rotating one part relative to another creates the offset.

5. The directional drilling apparatus of claim 1, wherein each of the body parts includes an offset, and in one relative orientation the offsets are compounded, and in another relative rotation the offsets are cancelled out.

6. The directional drilling apparatus of claim 1, wherein the body parts are sleeves.

7. The directional drilling apparatus of claim 1, wherein an inner body part provides mounting for the bit-mounting member.

8. The directional drilling apparatus of claim 1, wherein parts of the body are configurable such that relative axial movement of said parts induces relative rotation of said parts.

9. The directional drilling apparatus of claim 8, wherein said body parts define cooperating screw threads.

10. The directional drilling apparatus of claim 8, wherein one body part defines a track and another part defines a track follower.

11. The directional drilling apparatus of claim 10, wherein the track is helical and the track follower is a ball bearing.

12. The directional drilling apparatus of claim 1, wherein part of the body is extendable to engage a bore wall to restrict rotation of said body part.

13. The directional drilling apparatus of claim 12, wherein the extendable part of the body is mechanically actuated.

14. The directional drilling apparatus of claim 12, wherein the body part is extended by cooperation with another part of the body.

15. The directional drilling apparatus of claim 12, wherein the extendable part of the body comprises a blade mounted for radial movement relative to a body sleeve.

16. The directional drilling apparatus of claim 12, wherein the extendable body part is movable by engagement with a cam surface.

17. The directional drilling apparatus of claim 16, wherein said surface is defined by a relatively axially movable body part.

18. The directional drilling apparatus of claim 17, wherein movement of said axially movable body part creates the offset.

19. The directional drilling apparatus of claim 1, wherein parts of the member are relatively axially movable.

20. The directional drilling apparatus of claim 1, wherein parts of the member are telescopic.

21. The directional drilling apparatus of claim 1, wherein the axial force is applied by applying weight to the drill support.

22. The directional drilling apparatus of claim 1, wherein the coupling between the parts of the member and body permits relative rotation therebetween.

23. The directional drilling apparatus of claim 1, wherein the coupled parts of the member and body are selectively lockable to prevent relative axial movement therebetween.

24. The directional drilling apparatus of claim 23, wherein the coupled parts are lockable in position to provide said offset.

25. The directional drilling apparatus of claim 23, wherein the coupled parts are lockable in position to provide no offset.

26. The directional drilling apparatus of claim 23, wherein the coupled parts are lockable by locking members extending between parts of the member and the body.

27. The directional drilling apparatus of claim 26, further comprising a fluid-actuated member adapted to selectively support the locking members in a locking position.

28. The directional drilling apparatus of claim 27, wherein the fluid-actuated member is normally biased to a non-supporting position, such that reducing the flow rate of fluid through the apparatus allows the parts to be moved.

29. The directional drilling apparatus of claim 1, wherein means is provided for determining the orientation of the offset.

30. The directional drilling apparatus of claim 1, wherein, in use, the high side of a bore is determined and the relative orientation of the offset relative to the high side is determined.

31. The directional drilling apparatus of claim 1, wherein a mechanism is provided to return the body parts to a respective datum position to aid in determining the orientation of the offset.

32. The directional drilling apparatus of claim 1, wherein means is provided to indicate slippage of at least part of the body relative a bore wall.

33. The directional drilling apparatus of claim 32, wherein said means comprises fluid pressure indication means.

34. The directional drilling apparatus of claim 33, wherein said fluid pressure indication means comprises fluid pressure port means having at least two ports, wherein alignment of the ports indicates slippage of at least part of the body relative to a bore wall.

35. A directional drilling method comprising:

providing a drill bit on a bit-mounting member in a body, wherein at least one of a plurality of relatively movable parts of the member is coupled to at least one of a plurality of relatively movable parts of the body;

normally biasing the coupled parts of the member and the body to a position that provides no offset;

mounting the member on a drill support and locating the bit, member and body in a bore;

applying an axial force to the body to move parts of the body relative to one another and offset a portion of the bit-mounting member from an axis of the body; and rotating the drill support to rotate the drill bit, such that a deviated bore is drilled.

36. A directional drilling apparatus for mounting a drill bit on a rotatable drill support, the apparatus comprising:

a member for transmitting rotation from a rotatable drill support to a drill bit, wherein the member comprises a plurality of relatively movable parts;

a body mounted to the member and comprising a plurality of relatively movable parts, at least part of the body being configurable to resist rotation in a bore, wherein at least one of said parts of the member is coupled to a part of the body, further wherein the body is configurable such that application of an axial force to at least a part of the body causes parts of the body to move relative to one another and offset a portion of said member relative to an axis of the body;

locking members extending between parts of the member and the body, wherein the locking members selectively lock the coupled parts of the member and body to prevent relative axial movement therebetween; and a fluid-actuated member adapted to selectively support the locking members in a locking position, wherein the fluid-actuated member is normally biased to a non-supporting position, such that reducing the flow rate of fluid through the apparatus allows the parts to be moved.

37. A directional drilling method comprising:

providing a drill bit on a bit-mounting member in a body, wherein at least one of a plurality of relatively movable parts of the member is coupled to at least one of a plurality of relatively movable parts of the body;

locking the coupled parts of the member and body to prevent relative axial movement therebetween using locking members selectively supported in a locking position by a fluid actuated member normally biased to a non-supporting position such that reducing the flow rate of fluid through the apparatus allows the parts to be moved;

mounting the member on a drill support and locating the bit, member and body in a bore;

reducing the flow rate of fluid through the apparatus thereby allowing the coupled parts of the member and body to be moved;

applying an axial force to the body to move parts of the body relative to one another and offset a portion of the bit-mounting member from an axis of the body; and rotating the drill support to rotate the drill bit, such that a deviated bore is drilled.

* * * * *